US011123608B2

(12) United States Patent
Hsieh et al.

(10) Patent No.: US 11,123,608 B2
(45) Date of Patent: Sep. 21, 2021

(54) UPPER LIMB TRAINING SYSTEM AND CONTROL METHOD THEREOF

(71) Applicant: HIWIN TECHNOLOGIES CORP., Taichung (TW)

(72) Inventors: Fu-Han Hsieh, Taichung (TW); Yu-Wen Huang, Taichung (TW)

(73) Assignee: HIWIN TECHNOLOGIES CORP., Taichung (TW)

( * ) Notice: Subject to any disclaimer, the term of this patent is extended or adjusted under 35 U.S.C. 154(b) by 267 days.

(21) Appl. No.: 16/293,566

(22) Filed: Mar. 5, 2019

(65) Prior Publication Data

US 2020/0282263 A1 Sep. 10, 2020

(51) Int. Cl.
*A63B 24/00* (2006.01)
*A63B 21/005* (2006.01)
(Continued)

(52) U.S. Cl.
CPC ..... *A63B 24/0087* (2013.01); *A63B 21/0058* (2013.01); *A63B 21/4035* (2015.10);
(Continued)

(58) Field of Classification Search
CPC ..... A61H 1/02; A61H 1/0274; A61H 1/0277; A61H 1/0281; A61H 2201/0173; A61H 2201/1207; A61H 2201/1638; A61H 2201/1676; A61H 2201/50; A61H 2203/0431; A61H 2205/06; A63B 21/00178; A63B 21/00181; A63B 21/005; A63B 21/0058; A63B 21/4017; A63B 21/4027; A63B 21/4029; A63B 21/4031; A63B 21/4033; A63B 21/4035; A63B 21/4043; A63B 23/035; A63B 23/03508; A63B 23/12; A63B 23/1209; A63B 23/1245; A63B 23/1281; A63B 24/003; A63B 24/0006; A63B 24/0021;
(Continued)

(56) References Cited

U.S. PATENT DOCUMENTS 4,669,451 A * 6/1987 Blauth ..... A61F 5/013 601/33
4,934,694 A * 6/1990 McIntosh ..... A63B 24/00 482/137
(Continued)

FOREIGN PATENT DOCUMENTS

CN 102614066 A 8/2012
CN 203829261 A 9/2014
(Continued)

*Primary Examiner* — Gary D Urbiel Goldner
(74) *Attorney, Agent, or Firm* — Winston Hsu

(57) ABSTRACT

An upper limb training system adapted to an upper limb of a user includes a main body and a control unit. The main body includes a training unit and a plurality of motors. The training unit is connected to the upper limb. The plurality of motors are coupled to the training unit. The control unit is electrically connected to the training unit and the plurality of motors and calculates a plurality of torque intervals respectively corresponding to the plurality of motors according to torques generated by each of the plurality of motors. Besides, a control method adapted to the upper limb training system is also provided.

10 Claims, 10 Drawing Sheets

(51) Int. Cl.
*A63B 21/00* (2006.01)
*A63B 23/035* (2006.01)
*A63B 23/12* (2006.01)
*A63B 71/00* (2006.01)

(52) U.S. Cl.
CPC .... *A63B 23/03508* (2013.01); *A63B 23/1209* (2013.01); *A63B 24/0062* (2013.01); *A63B 2024/0093* (2013.01); *A63B 2071/0072* (2013.01); *A63B 2220/54* (2013.01)

(58) Field of Classification Search
CPC ..... A63B 24/0062; A63B 24/0075; A63B 24/0087; A63B 2024/0009; A63B 2024/0012; A63B 2024/0028; A63B 2024/0031; A63B 2024/0034; A63B 2024/0068; A63B 2024/0093; A63B 71/0009; A63B 71/0054; A63B 2071/0072; A63B 2213/00; A63B 2220/10; A63B 2220/20; A63B 2220/24; A63B 2224/30; A63B 2224/40; A63B 2220/50; A63B 2220/54
See application file for complete search history.

(56) References Cited

U.S. PATENT DOCUMENTS 5,103,404 A * 4/1992 McIntosh ..... A63B 24/00 318/568.22
5,117,814 A * 6/1992 Lullrell ..... A61F 5/0123 601/33
5,170,777 A * 12/1992 Reddy ..... A61H 1/0274 482/44
5,244,441 A * 9/1993 Dempster ..... A63B 23/00 482/9
5,417,643 A * 5/1995 Taylor ..... A61H 1/0274 601/24
5,466,213 A * 11/1995 Hogan ..... A61H 1/02 601/33
5,919,115 A * 7/1999 Horowitz ..... A63B 21/00181 482/6
6,155,993 A * 12/2000 Scott ..... A61B 5/4528 600/595
6,301,526 B1 * 10/2001 Kim ..... B25J 9/0006 600/1
6,589,190 B2 * 7/2003 Kanderian, Jr. ..... A61B 5/224 600/587
6,599,255 B2 * 7/2003 Zhang ..... A61H 1/02 600/587
7,618,381 B2 * 11/2009 Krebs ..... A61H 1/0285 601/5
7,862,524 B2 * 1/2011 Carignan ..... A61H 1/0281 601/5
8,317,730 B2 * 11/2012 Zhang ..... A61H 1/0288 600/595
8,926,534 B2 * 1/2015 McBean ..... A61F 5/013 601/5
9,017,271 B2 * 4/2015 Nef ..... A61H 1/0281 601/33
9,327,398 B2 * 5/2016 Sankai ..... B25J 9/0006
9,592,174 B2 * 3/2017 Hong ..... A61H 1/0277
10,130,546 B2 * 11/2018 Townsend ..... A61H 1/0237
10,456,614 B1 * 10/2019 Dube ..... A63B 21/068
10,702,988 B2 * 7/2020 Jian ..... B25J 9/1692
10,918,335 B2 * 2/2021 Lin ..... B25J 9/0006
2004/0249319 A1 * 12/2004 Dariush ..... A61H 3/00 601/5
2005/0102111 A1 * 5/2005 Dariush ..... B25J 9/0006 702/41
2006/0079817 A1 * 4/2006 Dewald ..... A61H 1/02 601/5
2008/0234608 A1 * 9/2008 Sankai ..... A61H 1/0244 601/5
2009/0149783 A1 * 6/2009 Nef ..... A63B 23/03508 601/5
2010/0249673 A1 * 9/2010 Nef ..... A61H 1/0281 601/33
2012/0165158 A1 * 6/2012 Ren ..... A63B 21/00178 482/7
2012/0330198 A1 * 12/2012 Patoglu ..... B25J 9/0006 601/33
2014/0212243 A1 * 7/2014 Yagi ..... A61H 1/024 414/2
2016/0367428 A1 * 12/2016 Townsend ..... A61H 1/0237
2018/0092792 A1 * 4/2018 Ohta ..... A61H 3/00
2018/0272525 A1 * 9/2018 Kumeno ..... B25J 9/1638
2018/0311498 A1 * 11/2018 Duncan ..... A61N 1/36003
2018/0330817 A1 11/2018 Avni
2018/0333861 A1 * 11/2018 Keibel ..... A63B 21/4034
2018/0338880 A1 * 11/2018 Ohta ..... A61H 3/008
2018/0338881 A1 * 11/2018 Ohtsubo ..... A61H 1/0244
2019/0090815 A1 * 3/2019 Lin ..... A61B 5/11
2019/0282425 A1 * 9/2019 Townsend ..... A61H 1/0237
2020/0246209 A1 * 8/2020 Bosio ..... A61H 1/0281
2020/0298402 A1 * 9/2020 Townsend ..... A61H 1/00

FOREIGN PATENT DOCUMENTS

CN 102614066 B 1/2016
CN 105764465 A 7/2016
CN 106726354 A 5/2017
CN 106913998 A 7/2017
CN 206566169 U 10/2017
CN 108175638 A 6/2018
CN 108392795 A 8/2018
CN 108524187 A 9/2018
DE 10 2015 000 919 A1 7/2016
JP H11-164859 A 6/1999
JP 2005-348779 A 12/2005
JP 3998415 B2 10/2007
JP 2010-200797 A 9/2010
KR 10-1694369 B1 1/2017
TW I587843 B 6/2017
WO 2013/018205 A1 2/2013

* cited by examiner

UPPER LIMB TRAINING SYSTEM AND CONTROL METHOD THEREOF

BACKGROUND OF THE INVENTION

1. Field of the Invention

The present invention relates to an upper limb training system and a control method thereof, and more particularly, to an upper limb training system capable of providing resistant torques to realize protection mode and a control method thereof.

2. Description of the Prior Art

Upper limb training is a significant subject of body movement training. In general, a limb of a user is connected to an auxiliary device and guided by an action director along a specific trajectory during the upper limb training. Then, the auxiliary device moves the limb along the trajectory made by the action director to achieve the result of training. However, an abnormal event may take place during the training. For example, the user may go into spasm due to muscle fatigue or other reasons. Therefore, action directors and inventors of auxiliary devices dedicate themselves to developing methods to detect or to prevent the abnormal event mentioned above. For example, Taiwan patent with publication number TW 1587843 disclosed a detecting method for lower limb spasm. When the user goes into spasm, the lower limb supporting frame stops the motors from running and the motion of stepping rehabilitation machine ends. Thereby, probable damage caused by the limb continuously driven by the machine after spasm occurs is prevented.

However, since the mode and range of exercising of lower limbs are relatively simple, the same mechanism cannot be introduced into an upper limb training device directly. Further, when the user goes into spasm, if the motors are stopped immediately, another type of damage may be caused since tension of the limbs has not been relieved yet. On the other hand, if the motors run continuously, the upper limb training device may accidentally hit a head portion or another body portion of the user while the tension of the user's upper limbs is relieved.

SUMMARY OF THE INVENTION

The present invention provides an upper limb training system with the control unit which is capable of calculating torques of motors and a position of an end of a training unit and controlling the motors to provide resistant torques to relieve tension of an upper limb of a user.

According to an embodiment of the present invention, the upper limb training system is adapted to an upper limb of a user and comprises a main body and a control unit. The main body comprises a training unit and a plurality of motors. The training unit is connected to the upper limb, and the plurality of motors are coupled to the training unit. The control unit is electrically connected to the training unit and the plurality of motors, calculates a position of an end of the training unit, and calculates a plurality of torque intervals respectively corresponding to the plurality of motors according to torques generated by each of the plurality of motors. When at least one of the torques generated by the plurality of motors exceeds the corresponding torque interval, and the end of the training unit does not move to a predetermined position, the control unit controls each of the plurality of motors to output a first torque to the training unit. When the at least one of the torques generated by the plurality of motors exceeds the corresponding torque interval, and the end of the training unit moves to the predetermined position, the control unit controls each of the plurality of motors to output a second torque to the training unit, so as to drive the end of the training unit to leave the predetermined position.

In addition, the present invention further provides a control method adapted to the upper limb training system. The control method prevents the user from hitting himself/herself during the upper limb training.

According to an embodiment of the present invention, the control method is adapted to an upper limb training system. The upper limb training system is adapted to an upper limb of a user and comprises a main body and a control unit, the main body comprises a training unit and a plurality of motors, and the training unit, the plurality of motors and the control unit are electrically connected to one another. The control method comprises executing a teaching procedure and executing a replaying procedure. The teaching procedure comprises connecting the upper limb to the training unit, guiding the training unit to move and recording a moving trajectory. The replaying procedure comprises the training unit driving the upper limb to move, gaining a plurality of torque intervals respectively corresponding to the plurality of motors, and executing a protection mode. The protection mode comprises the control unit determining whether torques generated by each of the plurality of motors exceed the corresponding torque interval, the control unit calculating a position of an end of the training unit and determining whether the end of the training unit moves to a predetermined position, and the control unit controlling each of the plurality of motors to output a first torque or a second torque to the training unit.

These and other objectives of the present invention will no doubt become obvious to those of ordinary skill in the art after reading the following detailed description of the preferred embodiment that is illustrated in the various figures and drawings.

DETAILED DESCRIPTION

The above and other technical features, characteristics and functions will be clearly presented in the following description with the drawings. It is noted that the terms "coupled" and "electrically connected" mean components are able to transmit electrical energy or data such as electric signals, magnetic signals and command signals in direct or indirect, wired or wireless manners. Therefore, the connection terms used are configured to illustrate and not to restrict the present invention. In addition, identical components or similar numeral references are used for identical components or similar components in the following embodiments.

Figure 1:
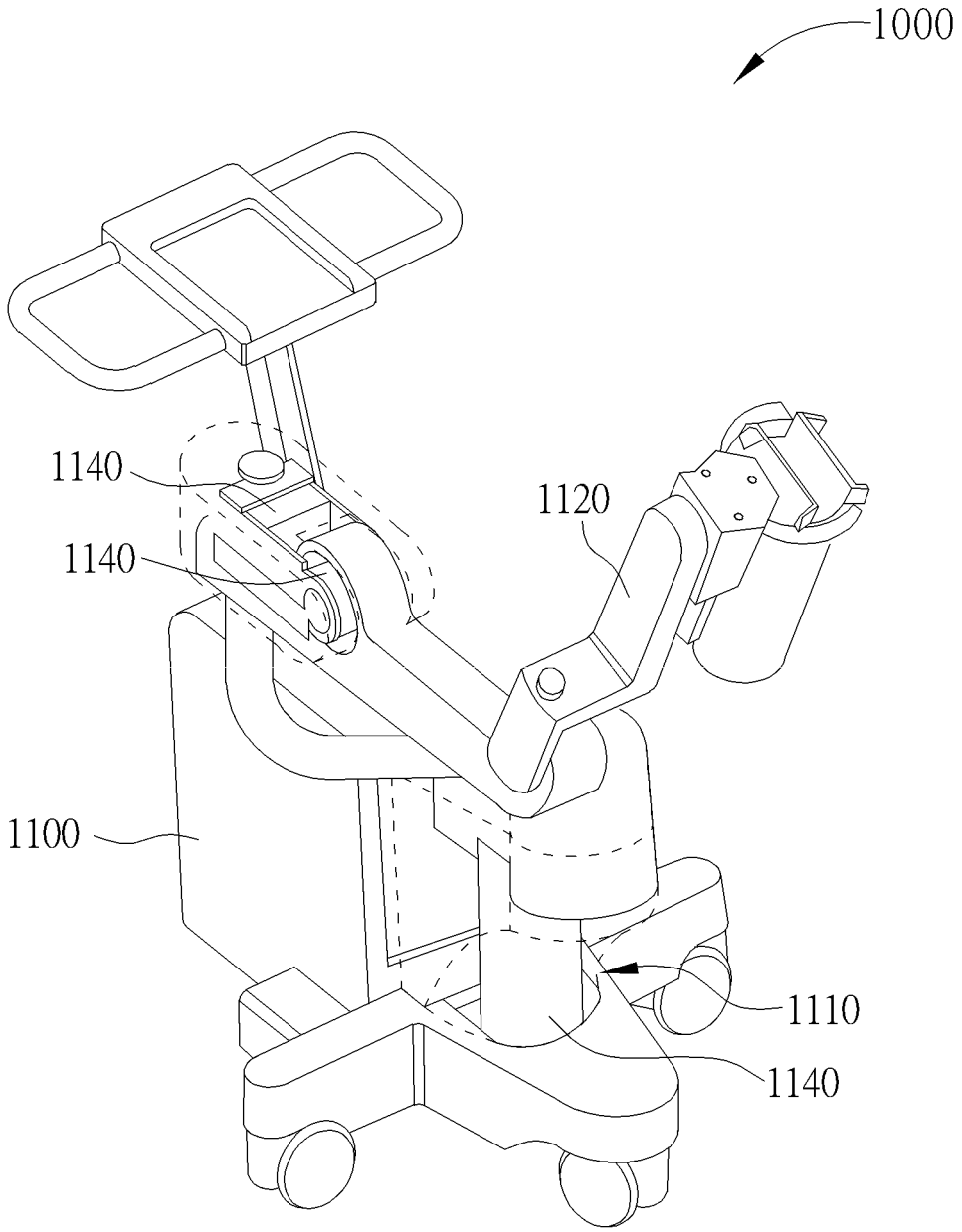
FIG. 1 is a perspective diagram of an upper limb training system according to an embodiment of the present invention.
Figure 2:
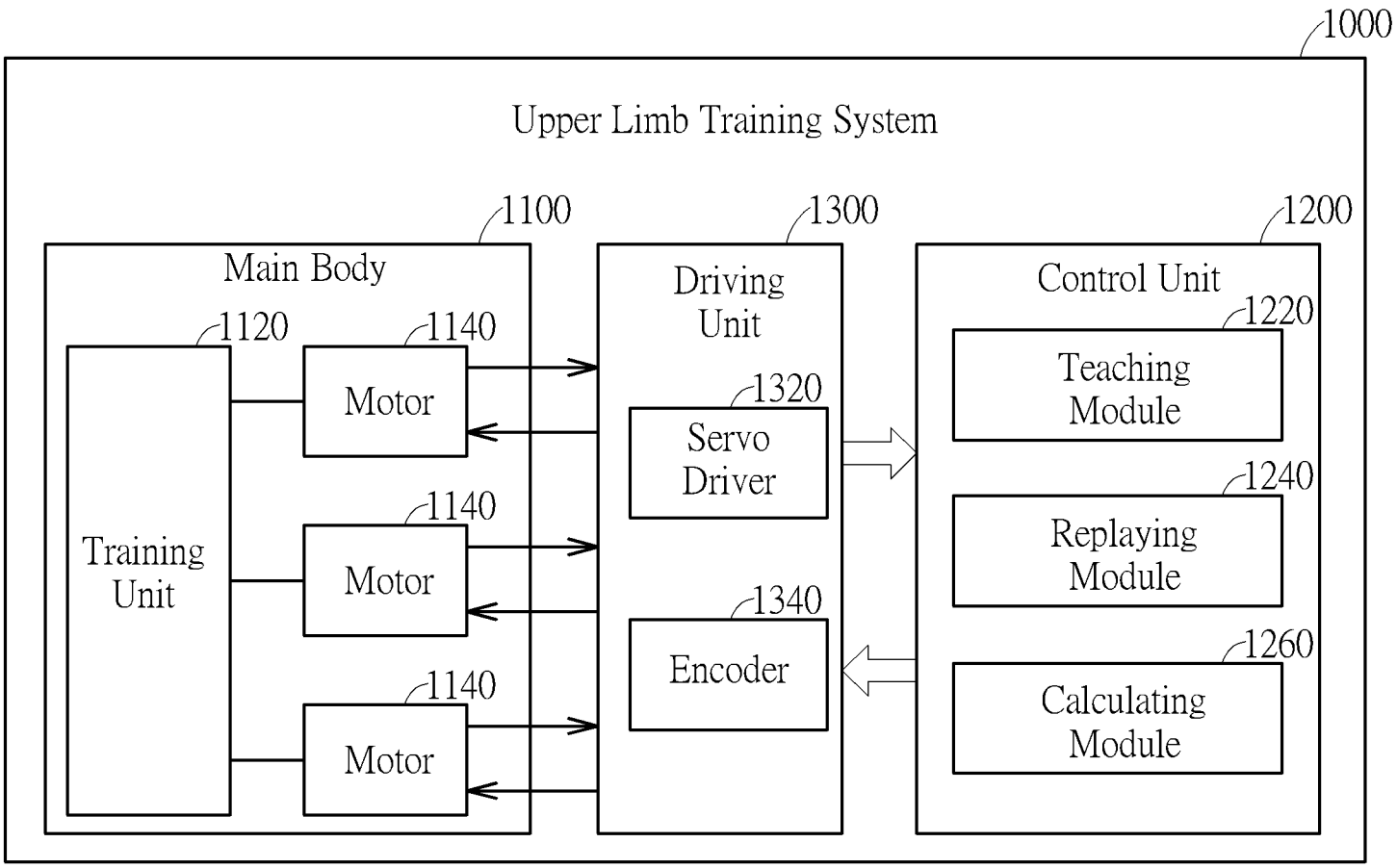
FIG. 2 is a function block diagram of the upper limb training system in FIG. 1.
Figure 3:
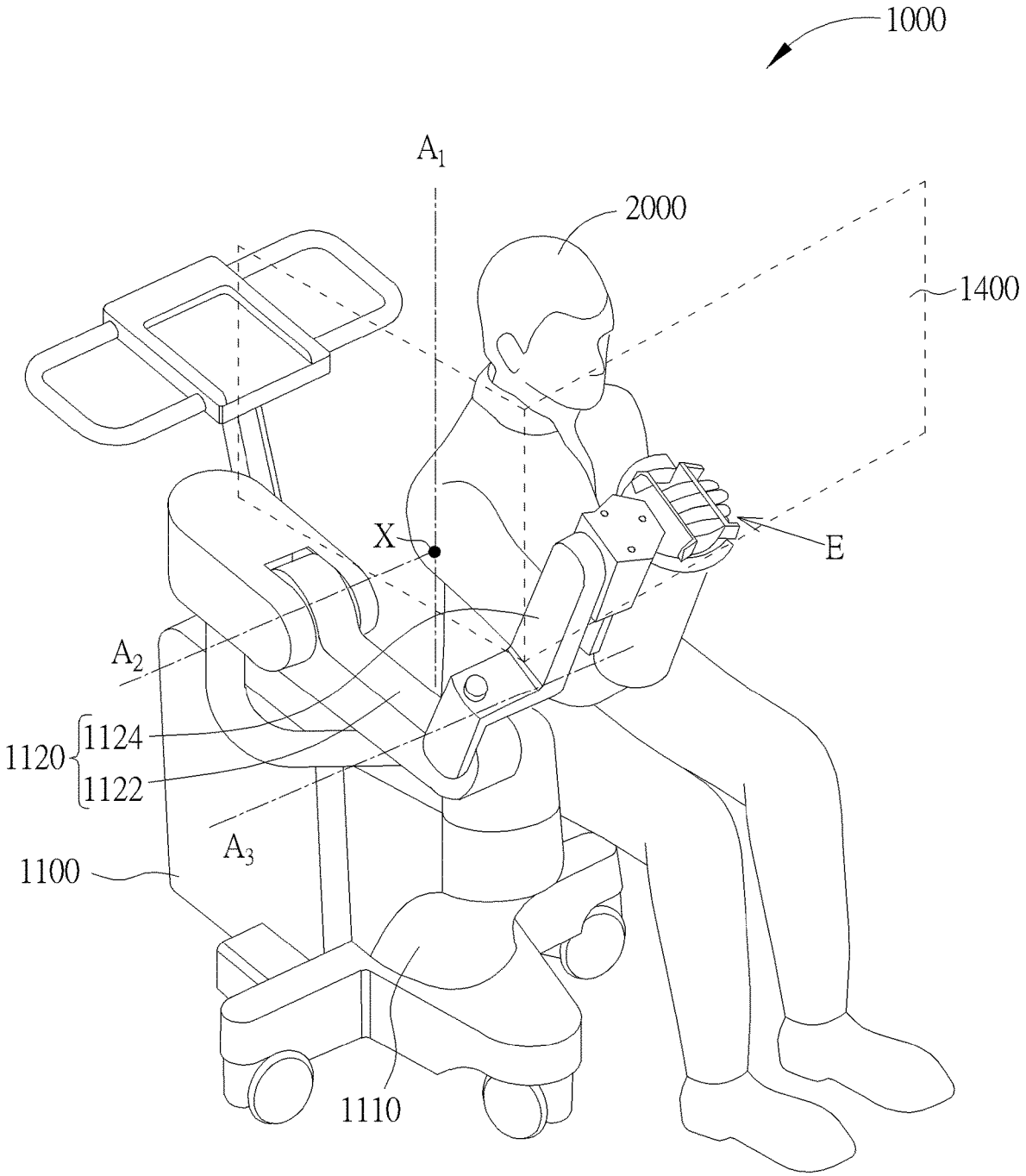
FIG. 3 is an illustration showing a user conducts upper limb training through the upper limb training system in FIG. 1.

FIG. 1 is a perspective diagram of an upper limb training system according to an embodiment of the present invention. FIG. 2 is a function block diagram of the upper limb training system in FIG. 1. FIG. 3 is an illustration showing a user conducts upper limb training through the upper limb training system in FIG. 1. Please refer to FIGS. 1-3. The upper limb training system 1000 according to the embodiment comprises a main body 1100, a control unit 1200 and a driving unit 1300. The main body 1100 comprises a base 1110, a training unit 1120 and a plurality of motors 1140. The training unit 1120 is connected to the base 1110, and the plurality of the motors 1140 are coupled to the training unit 1120. The control unit 1200 is electrically connected to the training unit 1120 and the plurality of the motors 1140, and the driving unit 1300 is electrically connected to the training unit 1120, the plurality of the motors 1140 and the control unit 1200.

Specifically, the upper limb training system 1000 is adapted to an upper limb of a user 2000. When the user 2000 conducts upper limb training, the training unit 1120 is connected to the upper limb. The training unit 1120 comprises a first link 1122 and a second link 1124 connected to the first link 1122. The first link 1122 rotates around a first axis $A_1$ and a second axis $A_2$ independent from the first axis $A_1$. The second link 1124 rotates around a third axis $A_3$ independent from the first axis $A_1$ and the second axis $A_2$. In the embodiment, the number of the motors 1140 is three, and the motors 1140 are respectively in charge of rotations of the first link 1122 and the second link 1124 around the above three axis. The first axis $A_1$ is a vertical axis around which the first link 1122 assists a shoulder joint to rotate when the user 2000 conducts the upper limb training; the second axis $A_2$ is a horizontal axis around which the first link 1122 assists the shoulder joint to rotate when the user 2000 conducts the upper limb training; the third axis $A_3$ is an axis around which the second link 1124 assist an elbow joint to rotate relative to the first link 1122 when user 2000 conducts the upper limb training. Therefore, while the user 2000 conducts the upper limb training with operating the upper limb training system 1000, the shoulder of the user 2000 is located at an intersection X between the first axis $A_1$ and the second axis $A_2$, and the elbow of the user 2000 is located in the third axis $A_3$. Thereby, the control unit 1200 is capable of calculating a position of an end E of the training unit 1120 according to lengths of the first link 1122 and the second link 1124, angles that the first link 1122 rotates around the first axis $A_1$ and the second axis $A_2$ and an angle that the second link 1124 rotates the third axis $A_3$. It is noted that the number of the first link 1122, the second link 1124, the motors 1140 and the corresponding rotational axes is not limited thereto. Any link able to assist the user 2000 to conduct the upper limb training, motors capable of providing power for the training and any rotational axis needed for conducting the training motion are within the scope of the present invention.

Figure 4:
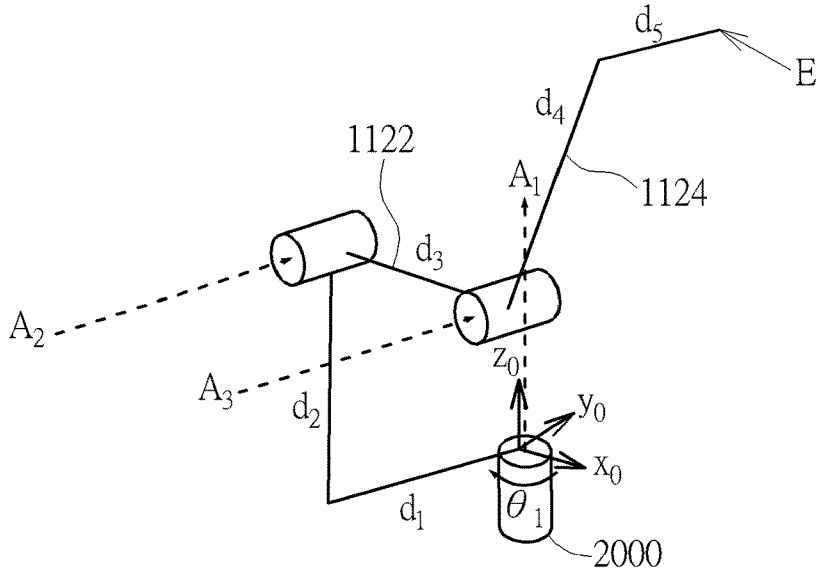
FIG. 4 is an illustration showing a position of an end of the training unit of the upper limb training system in FIG. 3.
Figure 5:
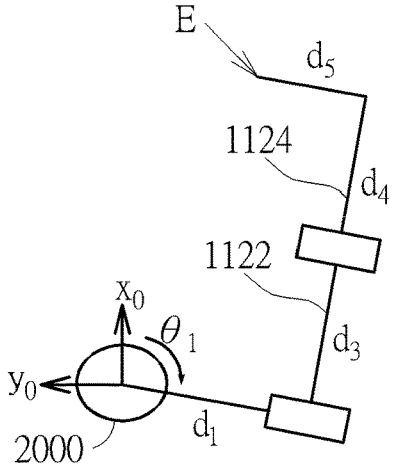
FIG. 5 is a top view of FIG. 4 along the first axis $A_1$.
Figure 6:
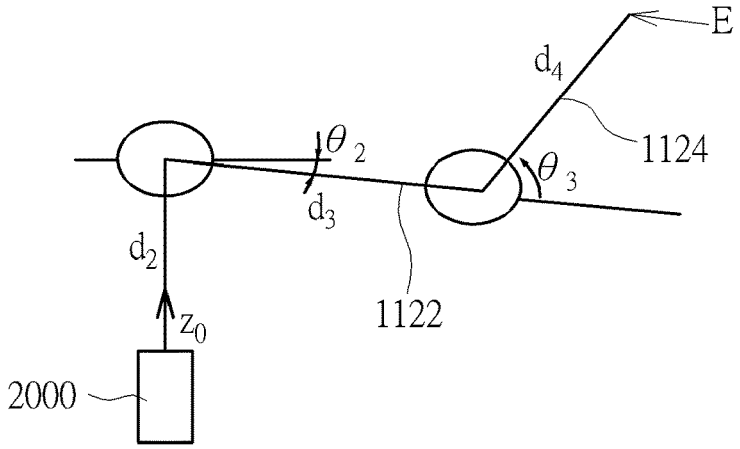
FIG. 6 is a side view of FIG. 4 along the second axis $A_2$.

FIG. 4 is an illustration showing a position of an end of the training unit of the upper limb training system in FIG. 3. FIG. 5 is a top view of FIG. 4 along the first axis $A_1$. FIG. 6 is a side view of FIG. 4 along the second axis $A_2$. Please refer to FIGS. 4-6. Furthermore, if the position that the training unit 1120 is connected to the base 1110 is defined as an origin, the frontal direction, the left direction and the up direction of the user 2000 when conducting the upper limb training are respectively defined as a direction $x_0$, a direction $y_0$ and a direction $z_0$, the lengths of the two links connected to the first link 1122, the length of the first link 1122, the length of the second link 1124 and the distance from the second link 1124 to the end E of the training unit 1120 are respectively defined as a distance $d_1$, a distance $d_2$, a distance $d_3$, a distance $d_4$ and a distance $d_5$, and the horizontal angle between the link with length $d_1$ and $x_0$, the vertical angle between the first link 1122 and $x_0$ and the vertical angle between the second link 1124 and an extending direction of the first link 1122 are respectively defined as an angle $\theta_1$, an angle $\theta_2$ and an angle $\theta_3$, wherein the angles $\theta_1$, $\theta_2$ and $\theta_3$ are regarded as positive along a clockwise direction in FIGS. 5 and 6, then an x-coordinate, a y-coordinate and a z-coordinate of the end E of the training unit 1120 relative to the origin can be calculated based on the following equations:

$$x=(d_1-d_5)\cos(\theta_1)-[d_3\cos(\theta_2)+d_4\cos(\theta_2+\theta_3)]\sin(\theta_1)$$

$$y=(d_1-d_5)\sin(\theta_1)+[d_3\cos(\theta_2)+d_4\cos(\theta_2+\theta_3)]\cos(\theta_1)$$

$$z=d_2-d_3\sin(\theta_2)-d_4\sin(\theta_2+d_3)$$

Wherein, sin and cos represent sinusoidal values and cosine values of the angles in the brackets. Thereby, the upper limb training system 1000 is capable of calculating a position coordinate of the end E relative to the portion where the training unit 1120 is connected to the main body 1100 via the control unit 1200.

Figure 7:
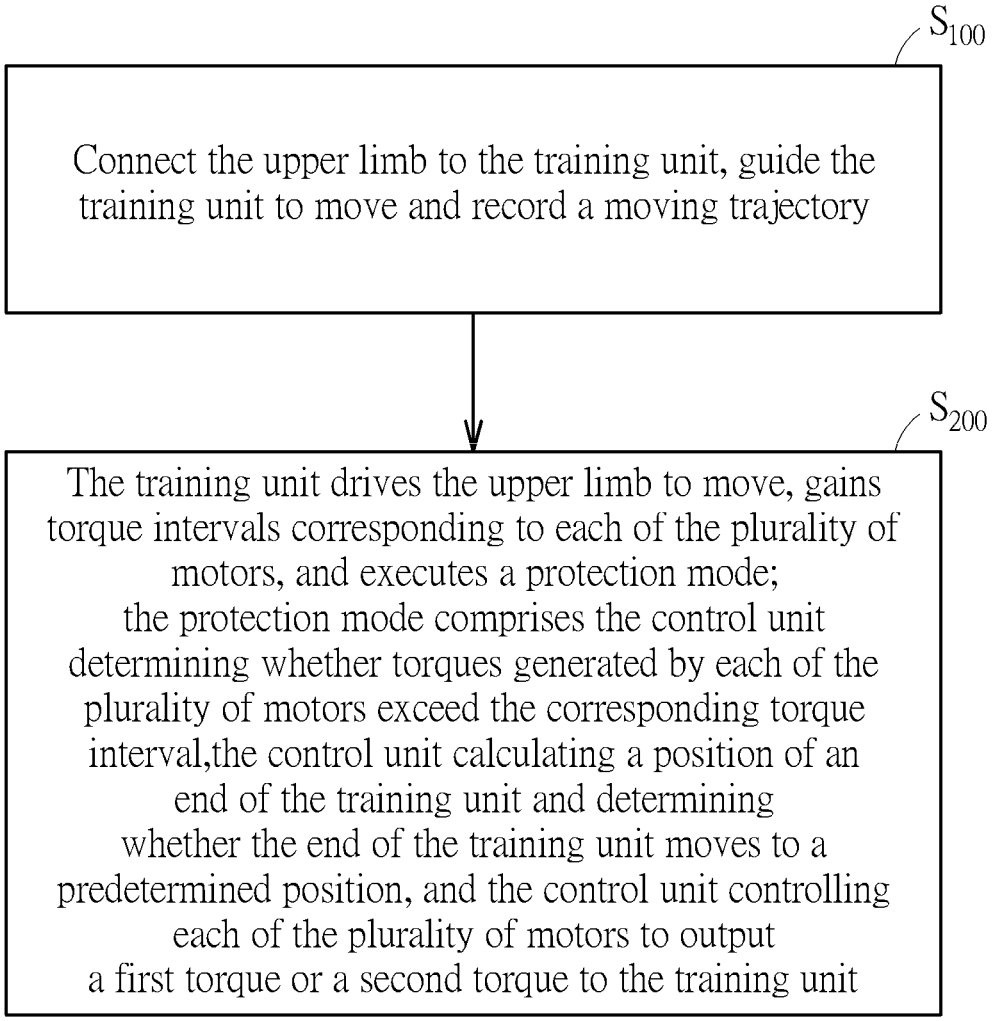
FIG. 7 is a flow chart of a control method according to an embodiment of the present invention.
Figure 8:
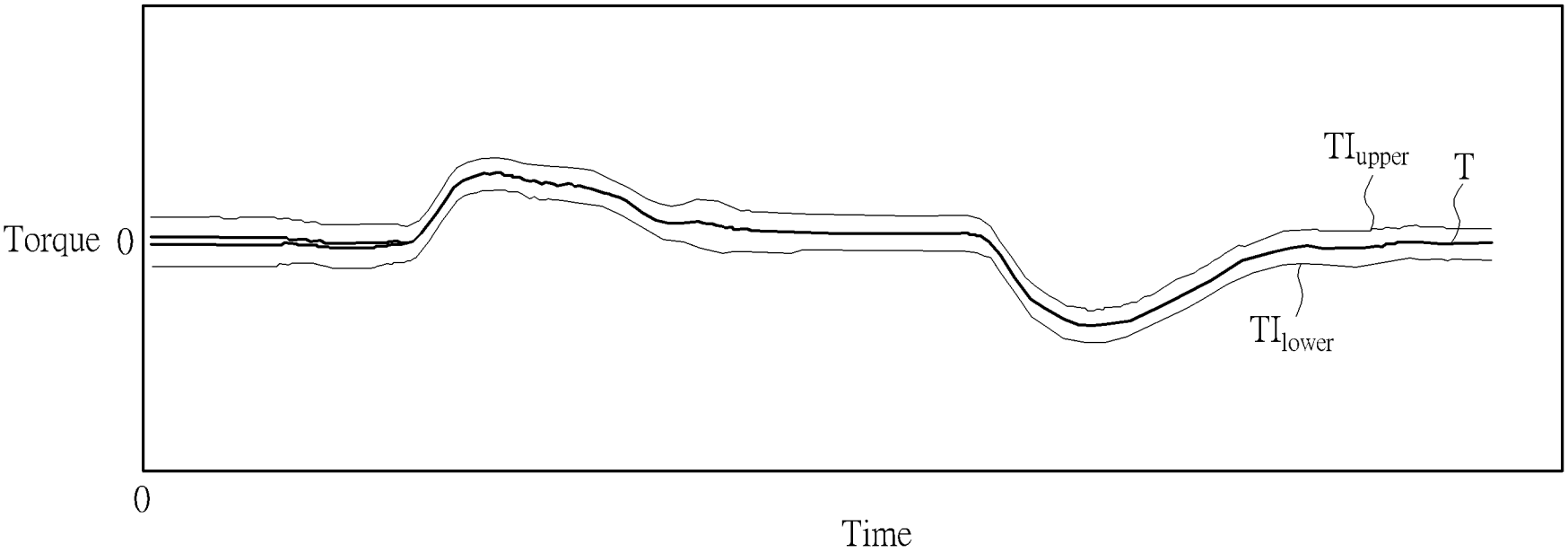
FIG. 8 is a diagram showing curves representing a torque of a motor of the upper limb training system and a torque interval corresponding to the motor.

FIG. 7 is a flow chart of a control method according to an embodiment of the present invention. FIG. 8 is a diagram showing curves representing a torque of a motor of the upper limb training system and a torque interval corresponding to the motor. Please refer to FIGS. 2, 7 and 8. The control method in the embodiment is adapted to the upper limb training system 1000. The control unit 1200 of the upper limb training system 1000 comprises a teaching module 1220, a replaying module 1240 and a calculating module 1260. Specifically, the control unit 1200 further comprises a module switching unit (not shown) configured to switch on different modules corresponding to different procedures in the upper limb training. The control method comprises executing a teaching procedure $S_{100}$ and executing a replaying procedure $S_{200}$. During the teaching procedure $S_{100}$, the user 2000 or an action director connects the upper limb of the user 2000 with the training unit 1120. Then the action director guides the upper limb of the user 2000 to move along a specific trajectory, and drives the training unit 1120 through the upper limb. Hereby, the teaching module 1220 records and saves the moving trajectory which the action director guided the upper limb along.

After the teaching procedure $S_{100}$ is completed, the action director or the user 2000 operates the upper limb training system 1000 to execute the replaying procedure $S_{200}$. Then, the replaying module 1240 of the control unit 1200 replays the moving trajectory recorded by the teaching module 1220 in the teaching procedure 5100. Specifically, the control unit 1200 transmits a command to the driving unit 1300. In the embodiment, the driving unit 1300 comprises a servo driver 1320 and an encoder 1340. When the driving unit 1300 receives the command from the control unit 1200, the servo driver 1320 drives each of the motors 1140 so as to drive the training unit 1120 to move along the moving trajectory recorded by the teaching module 1220 in the teaching procedure 5100. It is noted that the driver for the motors employed in the driving unit 1300 is not limited to the servo driver 1320. Drivers capable of driving corresponding motors 1140 to replay the recorded trajectory, such as linear drivers or stepping drivers, are within the scope of the present invention.

After the upper limb training system 1000 drives the upper limb of the user 2000 and the training unit 1120 to move along the mentioned moving trajectory for a plurality of times, the driving unit 1300 senses the torques T generated by each of the motors 1140, and encodes a plurality of sets of the torques T generated by each of the motors 1140 corresponding to each movement of the training unit 1120 into a data. The data is then transmitted to the control unit 1200. After the control unit 1200 receives the data, the calculating module 1260 defines a mean torque $\mu_i$, which is a mean value of the plurality of sets of the torques T generated by each of the plurality of motors 1140 corresponding to the each movement of the training unit 1120, and defines a torque standard deviation $\sigma_i$, which is a standard deviation of the plurality sets of the torques T generated by each of the plurality of motors 1140 corresponding to the each movement of the training unit 1120. An upper bound $TI_{upper}$ and a lower bound $TI_{lower}$ of one of a plurality of torque intervals respectively corresponding to the motors 1140 are calculated by the following equations:

$$TI_{upper}=\mu_i+(\delta+w)\sigma_i$$

$$TI_{lower}=\mu_i-(\delta+w)\sigma_i$$

Wherein, i is an index number of each of the motors 1140; δ is a sensitivity parameter, which is a positive real number theoretically and between zero and fifteen in the embodiment, and is adjustable by the action director according to condition for different users 2000; w is a weight factor, which is three in the embodiment but is not limited thereto. In other words, in the teaching procedure $S_{100}$, the action director or the user 2000 is able to drive the training unit 1120 to move via the upper limb and to gain the torque intervals respectively corresponding to the motors 1140, as shown in FIG. 8.

Figure 9:
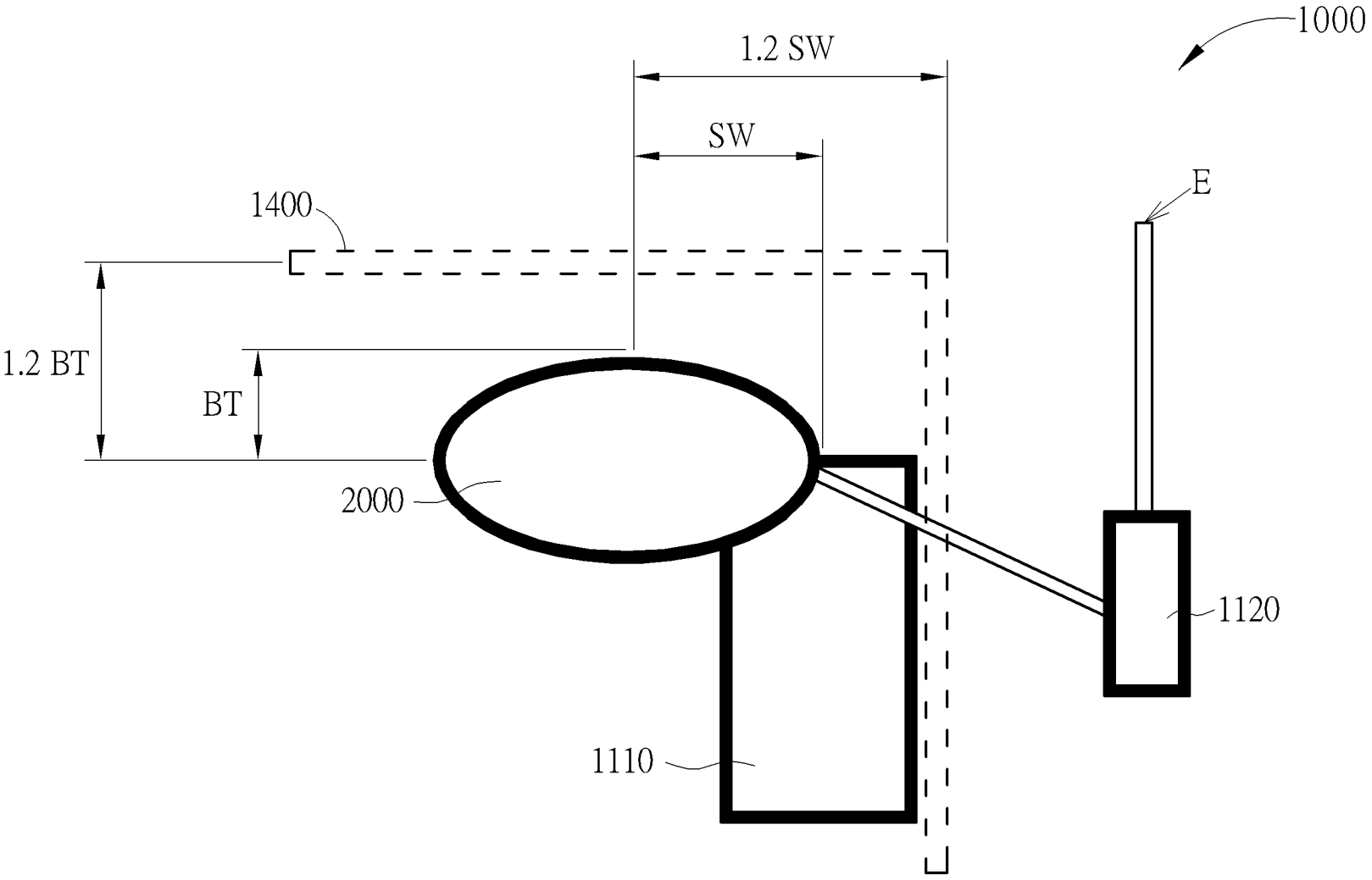
FIG. 9 is an illustration showing the upper limb training system and the virtual wall in FIG. 3.

Besides, in the replaying procedure $S_{200}$, the control unit 1200 further executes a protection mode. FIG. 9 is an illustration showing the upper limb training system and the virtual wall in FIG. 3. Please refer to FIGS. 3 and 9. In the embodiment, a virtual wall 1400 is further defined between a head portion of the user 2000 and the end E of the training unit 1120. The virtual wall 1400 comprises two planes perpendicular to each other. Specifically, as shown in FIG. 9, if a body of the user 2000 is simplified as an ellipse, a shoulder width SW of the user 2000 is equal to a distance between the center of the ellipse and an end of the right-side major axis, and a breast thickness BT of the user 2000 is equal to a distance between the center of the ellipse and an end of the front-side minor axis. In the embodiment, the upper limb training system 1000 multiplies a shoulder width SW and a breast thickness BT according to 95 percentile of a human body in human factors and ergonomics by a safety factor 1.2 to gain distances from the user 2000 and the two planes comprised by the virtual wall 1400. That is, the 1.2 SW and the 1.2 BT in FIG. 9.

In greater detail, the virtual wall 1400 defines a secure range of the user 2000. When an abnormal event occurs during the user 2000 conducting the upper limb training, for example, an upper limb spasm of the user 2000, and the end E of the training unit 1120 is located inside the virtual wall 1400 with respect to the user 2000, a head portion or the body of the user 2000 may be hit by the training unit 1120 which is driven by the spasm. Thereby, the control unit 1200 provides the training unit 1120 with a corresponding resistant torque according to a depth by which the training unit 1120 penetrates into the virtual wall 1400. That is, the deeper the training unit 1120 penetrates into the virtual wall 1400, the greater resistant torque output to the training unit 1120 generated by each of the motors 1140 controlled by the control unit 1200 is.

Figure 10:
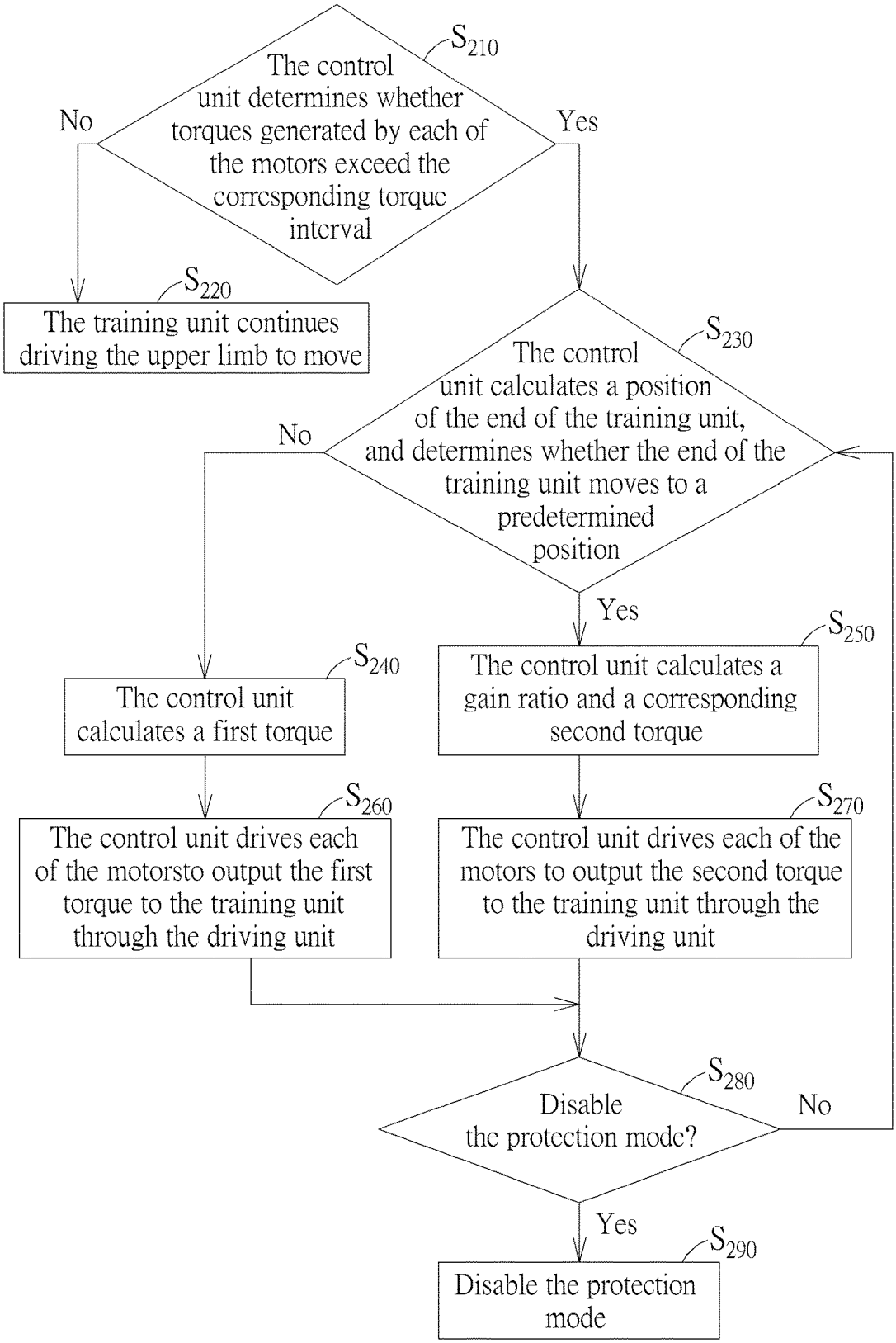
FIG. 10 is a flow chart of the protection mode in FIG. 7.

FIG. 10 is a flow chart of the protection mode in FIG. 7. Please refer to FIGS. 7 and 10. When the protection mode is executed, the control unit 1200 determines whether torques T generated by each of the motors 1140 exceed the corresponding torque interval (step $S_{210}$) while the training unit 1120 replays the moving trajectory recorded. If the torques T do not exceed the corresponding torque interval, the training unit 1120 continues driving the upper limb to move (step $S_{220}$). If at least one of the torques T generated by the motors 1140 exceeds the torque interval corresponding to the each motor, it means that an abnormal event occurs. For example, the upper limb spasm of the user 2000. Then the control unit 1200 calculates a position of the end E of the training unit 1120, and determines whether the end E of the training unit 1120 moves to a predetermined position (step $S_{230}$). In the embodiment, the predetermined position is located on or inside the virtual wall 1400 with respect to the user 2000. When at least one of the torques T generated by the motors 1140 exceeds the torque interval corresponding to each of the motors 1140, but the end E of the training unit 1120 does not move to the predetermined position, it means that the user 2000 has upper limb spasm but will not hit himself/herself. Then the calculating module 1260 of the control unit 1200 calculates a first torque $T_1$ for balancing gravity of the training unit 1120 according to its position (step $S_{240}$), and the control unit 1200 drives each of the motors 1140 to output the first torque $T_1$ to the training unit 1120 through the servo driver 1320 of the driving unit 1300 (step $S_{250}$). Since the gravity of the upper limb of the user 2000 and the training unit 1120 is balanced by the first torque $T_1$, the tension caused by the spasm can be relieved with the upper limb of the user 2000 bearing lower loading, and probable damage is thus prevented.

However, if at least one of the torques T generated by the motors 1140 exceeds the torque interval corresponding to each of the motors 1140, and the end E of the training unit 1120 moves to the predetermined position located on or inside the virtual wall 1400 with respect to the user 2000, the user 2000 may be hit by the training unit 1120 driven by spasm of his/her upper limb. Then the calculating module 1260 calculates a second torque $T_2$ balancing gravity of the training unit 1120 according to its position and resisting movement of the training unit 1120 toward center of the body of the user 2000. The second torque $T_2$ is defined by a gain ratio G and an original torque $T_{original}$. Specifically, the second torque $T_2$ satisfies the following equation:

$$T_2=G\times T_{original}$$

When the end E of the training unit 1120 is located inside the virtual wall 1400 with respect to the user 2000, and a distance D between the end E of the training unit 1120 and the virtual wall 1400 is greater than a previous calculated distance therebetween, it means that the upper limb of the user 2000 still moves toward the center of body. Then the gain ratio G is defined by an unadjusted gain ratio G*, the distance D, a distance weighting factor $K_p$, a velocity $V_d$ of the end E of the training unit 1120 relative to the virtual wall 1400 and a velocity weighting factor $K_v$. Specifically, the gain ratio G satisfies the following equation:

$$G=G^*+K_p\times D+K_v\times V_d$$

When the end E of the training unit 1120 is located inside the virtual wall 1400 with respect to the user 2000, and the distance D between the end E of the training unit 1120 and the virtual wall 1400 is smaller than or equal to the previous calculated distance therebetween, it means that the upper limb of the user 2000 gradually moves outward the virtual wall 1400. Then the gain ratio G equals to the unadjusted gain ratio G* minus a constant value C. Specifically, the gain ratio G satisfies the following equation:

$$G=G^*-C$$

In other words, the calculating module 1260 of the control unit 1200 calculates the gain ratio G and the corresponding second torque $T_2$ (step $S_{250}$), and drives each of the motors 1140 to output the second torque $T_2$ to the training unit 1120 through the servo driver 1320 of the driving unit 1300 (step $S_{270}$), so as to drive the end E of the training unit 1120 outside the virtual wall 1400. Thereby, the probable damage to the user 2000 due to an abnormal event, for example, upper limb spasm of the user 2000, can be prevented during the training unit 1120 moving and driving the upper limb of the user 2000 along the recorded moving trajectory. Besides, the tension due to upper limb spasm of the user 2000 can be relieved. When the control unit 1200 detects that the end E of the training unit 1120 moves outside the virtual wall 1400 (step $S_{280}$), the action director can disable the protection mode (step $S_{290}$), so as to return the system to the teaching process of the teaching procedure $S_{100}$.

Figure 11:
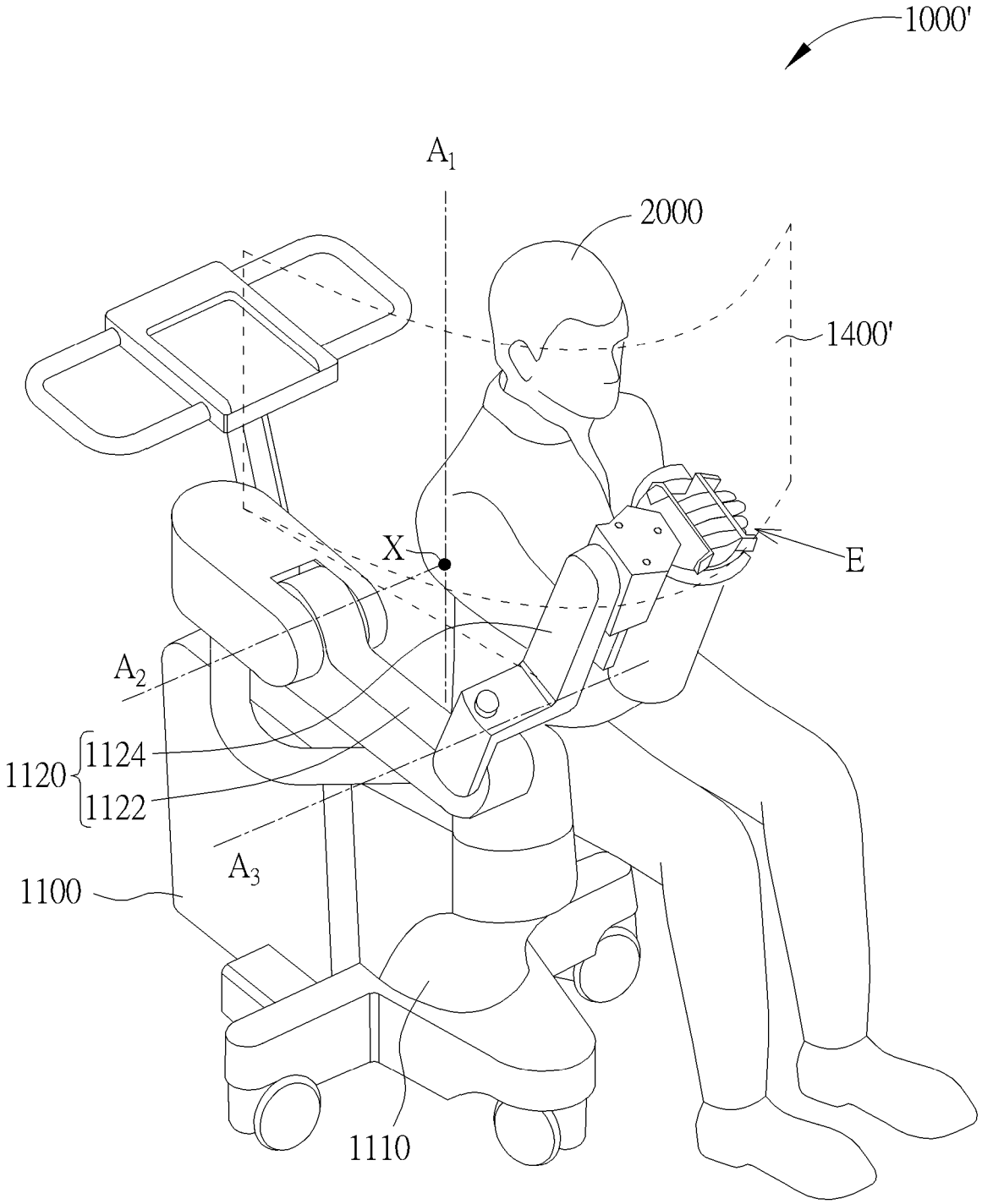
FIG. 11 is an illustration showing a user conducts upper limb training through an upper limb training system according to an embodiment of the present invention.

FIG. 11 is an illustration showing a user conducts upper limb training through an upper limb training system according to an embodiment of the present invention. Please refer to FIGS. 3 and 11. The upper limb training system 1000' in the embodiment is similar to the upper limb training system 1000 in FIG. 3. The major difference is: the virtual wall 1400' defined in the upper limb training system 1000' does not comprise two perpendicular planes but an arc surface. Thereby, the probable damage of hitting himself/herself due to upper limb spasm can be prevented as well.

Figure 12:
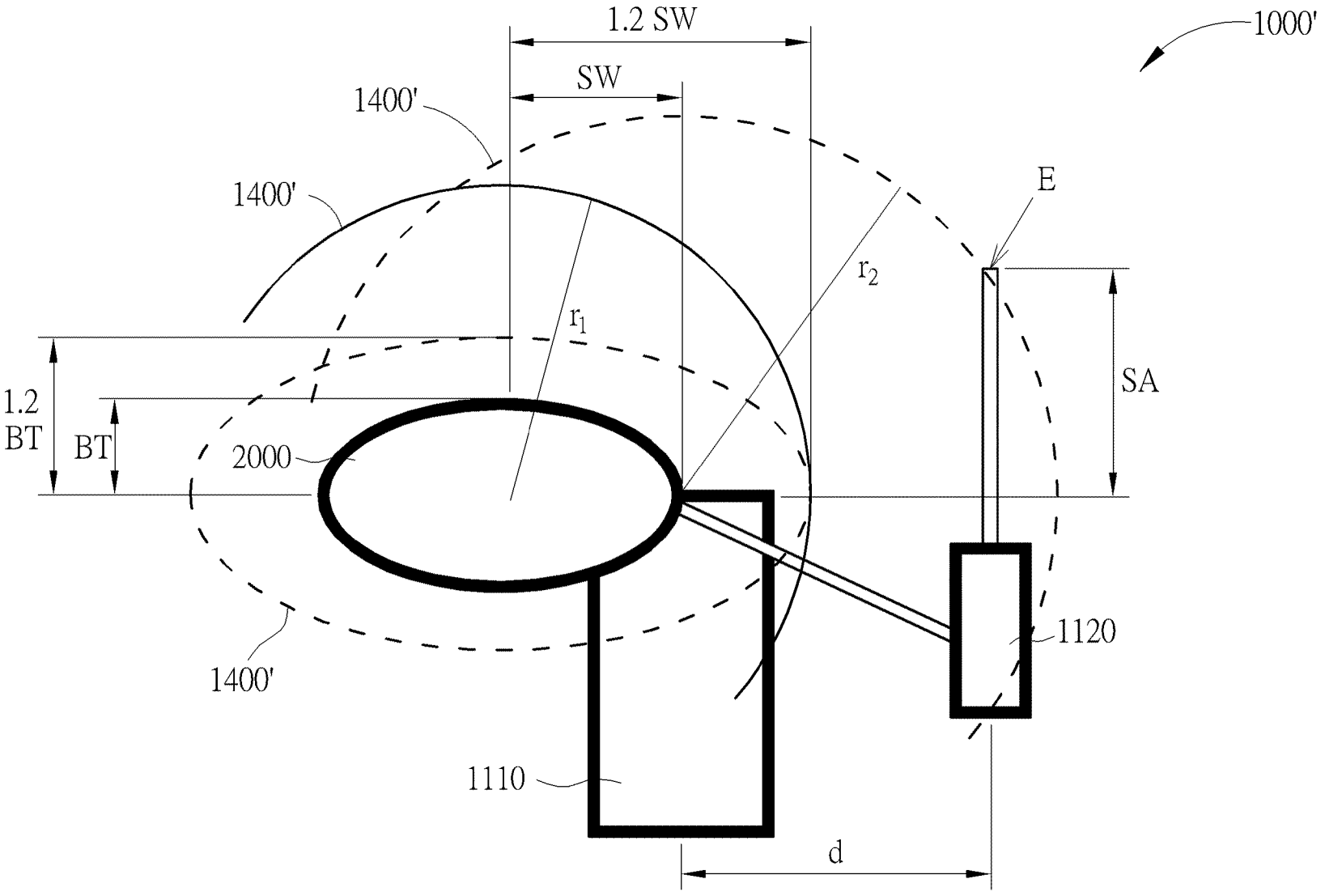
FIG. 12 is an illustration showing the upper limb training system and the virtual wall in FIG. 11.

FIG. 12 is an illustration showing the upper limb training system and the virtual wall in FIG. 11. Please refer to FIG. 12. In detail, the virtual wall 1400' of the upper limb training system 1000' is allowed by various definitions. As shown in FIG. 12, if the body of the user 2000 is simplified as an ellipse, in view of the above mentioned calculation, a first type of cylindrical virtual wall 1400' with a radius $r_1$ and a center of the ellipse is gained, where the radius $r_1$ is the shoulder width SW according to 95 percentile of the human body in human factors and ergonomics multiplied by the safety factor 1.2. Besides, a second type of cylindrical virtual wall 1400' with a radius $r_2$ can be also gained, where the radius $r_2$ is a hypotenuse formed by two cathetuses whose lengths are respectively equal to a length d of the main body 1100 and a safety allowance SA, and the center of the second type of cylindrical virtual wall 1400' is located at where the training unit 1120 being connected to the main body 1000. Besides, a third type of elliptical cylinder virtual wall 1400' can be gained, where a length of the half major axis equals to 1.2 SW, a length of the half minor axis equals to 1.2 BT, and the center of the third type of elliptical cylinder virtual wall 1400' is the center of the body of the user 2000. Since the geometries of the mentioned virtual wall 1400 and virtual wall 1400' are based on statistical data in human factors and ergonomics, the positions of the virtual wall 1400 or the virtual wall 1400' are not affected by different users, and the goal to defining a secure range for the user 2000 can be achieved.

In summary, the upper limb training system of the present invention is capable of detecting whether an abnormal event, such as spasm, occurs while a user conducts upper limb training through the control unit calculating the torque interval corresponding to each of the motors. In addition, according to the control method of the present invention, when the user goes into spasm by his/her upper limb during the upper limb training, the control unit is capable of controlling each of the motors to output the first torque or the second torque to relieve the tension of the upper limb of the user due to spasm, and prevent the user from hitting himself/herself through driving the upper limb training system to strike the head portion or other body portion.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An upper limb training system adapted to an upper limb of a user, comprising:

a main body, comprising:

a training unit configured to be connected to the upper limb; and a plurality of motors coupled to the training unit; and a control unit electrically connected to the training unit and the plurality of motors, the control unit calculating a position of an end of the training unit and calculating a plurality of torque intervals respectively corresponding to the plurality of motors according to torques generated by each of the plurality of motors;

wherein, when at least one of the torques generated by the plurality of motors exceeds the corresponding torque interval, and the end of the training unit does not move to a predetermined position, the control unit controls each of the plurality of motors to output a first torque to the training unit;

wherein, when the at least one of the torques generated by the plurality of motors exceeds the corresponding torque interval, and the end of the training unit moves to the predetermined position, the control unit controls each of the plurality of motors to output a second torque to the training unit, so as to drive the end of the training unit to leave the predetermined position.

2. The upper limb training system of claim 1, further comprising:

a driving unit electrically connected to the training unit, the plurality of motors and the control unit, the driving unit sensing the torques generated by each of the plurality of motors and transmitting a data to the control unit, the data comprising a plurality of sets of the torques generated by each of the plurality of motors corresponding to each movement of the training unit, the control unit calculates the torque intervals corresponding to each of the plurality of motors according to the data, and the control unit driving each of the plurality of motors to output the first torque or the second torque to the training unit through the driving unit.

3. The upper limb training system of claim 2, wherein an upper bound and a lower bound of one of the torque intervals are defined by a mean torque, a weighting factor and a torque standard deviation of the corresponding motor, the mean torque is a mean value of the plurality of sets of the torques generated by each of the plurality of motors corresponding to the each movement of the training unit, and the torque standard deviation is a standard deviation of the plurality sets of the torques generated by each of the plurality of motors corresponding to the each movement of the training unit.

4. The upper limb training system of claim 1, wherein a virtual wall is further defined, the virtual wall is configured to be located between a head portion of the user and the end of the training unit, the predetermined position is on or inside the virtual wall with respect to the user, and the end of the training unit leaves the predetermined position to move outside the virtual wall.

5. The upper limb training system of claim 4, wherein the virtual wall comprises two planes perpendicular to each other or an arc surface.

6. The upper limb training system of claim 4, wherein the second torque is defined by a gain ratio and an original torque;

wherein, when the end of the training unit is located inside the virtual wall with respect to the user, and a distance between the end of the training unit and the virtual wall is greater than a previously calculated distance therebetween, the gain ratio is defined by an unadjusted gain ratio, the distance, a distance weighting factor, a velocity of the end of the training unit relative to the virtual wall and a velocity weighting factor;

wherein, when the end of the training unit is located inside the virtual wall with respect to the user, and the distance between the end of the training unit and the virtual wall is smaller than the previously calculated distance therebetween, the gain ratio is equal to the unadjusted gain ratio minus a constant value.

7. A control method adapted to the upper limb training system of claim 1, the control method comprising:

executing a teaching procedure, the teaching procedure comprising connecting the upper limb to the training unit, guiding the training unit to move and recording a moving trajectory; and executing a replaying procedure, the replaying procedure comprising the training unit driving the upper limb to move, gaining the plurality of torque intervals respectively corresponding to the plurality of motors, and executing a protection mode, the protection mode comprising:

the control unit determining whether the torques generated by each of the plurality of motors exceed the corresponding torque interval;

the control unit calculating the position of the end of the training unit, and determining whether the end of the training unit moves to the predetermined position; and the control unit controlling each of the plurality of motors to output the first torque or the second torque to the training unit.

8. The control method of claim 7, wherein the upper limb training system further comprises a driving unit, the driving unit is electrically connected to the training unit, the plurality of motors and the control unit, and the replaying procedure further comprises:

the driving unit sensing the torques generated by each of the plurality of motors and transmitting a data to the control unit, the data comprising a plurality of sets of the torques generated by each of the plurality of motors corresponding to each movement of the training unit; and the control unit calculating the torque intervals corresponding to each of the plurality of motors according to the data, and driving each of the plurality of motors to output the first torque or the second torque to the training unit through the driving unit.

9. The control method of claim 7, wherein the protection mode further comprises:

when the control unit determines the at least one of the torques generated by the plurality of motors exceeds the torque interval corresponding to each of the plurality of motors, and the end of the training unit does not move to the predetermined position, the control unit controls each of the plurality of motors to output the first torque to the training unit; and when the control unit determines the at least one of the torques generated by the plurality of motors exceeds the corresponding torque interval, and the end of the training unit moves to the predetermined position, the control unit controls each of the plurality of motors to output the second torque to the training unit, so as to drive the end of the training unit to leave the predetermined position.

10. The control method of claim 7, wherein the protection mode further comprises defining a virtual wall configured to be located between a head portion of the user and the end of the training unit, the predetermined position is located on or inside the virtual wall with respect to the user, wherein when the control unit controls each of the plurality of motors to output the second torque to the training unit, the end of the training unit moves outside the virtual wall.

* * * * *